US009420852B2

(12) United States Patent
Chen et al.

(10) Patent No.: US 9,420,852 B2
(45) Date of Patent: Aug. 23, 2016

(54) METHOD OF GLUING A SINGLE SURFACE OF A SHOE

(71) Applicant: NAN PAO RESINS CHEMICAL CO., LTD., Tainan (TW)

(72) Inventors: Chien-Hsiung Chen, Tainan (TW); Chia-Tai Liu, Tainan (TW)

(73) Assignee: Nan Pao Resins Chemical Co., Ltd., Tainan (TW)

( * ) Notice: Subject to any disclaimer, the term of this patent is extended or adjusted under 35 U.S.C. 154(b) by 211 days.

(21) Appl. No.: 14/454,794

(22) Filed: Aug. 8, 2014

(65) Prior Publication Data

US 2016/0037864 A1 Feb. 11, 2016

(51) Int. Cl.

| | |
|---|---|
| ***A43D 25/06*** | (2006.01) |
| ***A43D 25/16*** | (2006.01) |
| ***A43D 25/20*** | (2006.01) |
| *A43D 25/047* | (2006.01) |
| *A43D 25/18* | (2006.01) |

(52) U.S. Cl.

CPC ..... *A43D 25/06* (2013.01); *A43D 25/16* (2013.01); *A43D 25/20* (2013.01); *A43D 25/047* (2013.01); *A43D 25/18* (2013.01)

(58) Field of Classification Search

CPC ..... A43D 25/06; A43D 25/16; A43D 25/18; A43D 25/20; A43D 25/00; A43D 25/047

USPC ..... 12/142 F, 142 T, 142 R

See application file for complete search history.

(56) References Cited

U.S. PATENT DOCUMENTS

| | | | | |
|---|---|---|---|---|
| 4,156,947 | A * | 6/1979 | Nadler | A43B 9/00 12/142 R |
| 4,662,018 | A * | 5/1987 | Autry | A43B 9/00 12/142 RS |
| 4,899,411 | A * | 2/1990 | Johnson | A43B 3/0084 12/142 E |
| 9,320,312 | B2 * | 4/2016 | Lyttle | A43B 1/00 |
| 2002/0073577 | A1 * | 6/2002 | Bray, Jr. | A43B 3/102 36/9 R |
| 2007/0136960 | A1 * | 6/2007 | Doerer | A43B 13/02 12/146 B |
| 2010/0050469 | A1 * | 3/2010 | Chen | A43B 1/0009 36/10 |
| 2010/0319221 | A1 * | 12/2010 | McClaskie | A43B 9/02 36/25 R |
| 2011/0088285 | A1 * | 4/2011 | Dojan | A43B 1/04 36/87 |
| 2011/0277349 | A1 * | 11/2011 | Kim | A43B 3/0005 36/84 |
| 2012/0144698 | A1 * | 6/2012 | McDowell | B29D 35/146 36/45 |
| 2013/0247418 | A1 * | 9/2013 | Nurse | A43B 3/0031 36/92 |

* cited by examiner

*Primary Examiner* — Jila M Mohandesi

(74) *Attorney, Agent, or Firm* — Alan D. Kamrath; Kamrath IP Lawfirm, P.A.

(57) ABSTRACT

A method of gluing a single surface of a shoe contains a first-stage processing and a second-stage processing. The first-stage processing includes a sole bonding having a first washing and polishing step, a first surface modifying step, a glue spraying step, and a sole adhering step. The second-stage processing includes a second washing and polishing step, a second surface modifying step, and an adhesive agent coating step. A vamp and sole processing includes a vamp treating step, a treatment agent coating step, and an adhesion forming step. A shoe midsole on which an adhesion promoter is sprayed and a shoe outsole on which adhesive glue is coated are adhered together to finish a shoe sole. The adhesive glue is coated on an upper surface of the shoe sole to adhere with a lower adhering surface of a vamp on which a treatment agent is coated, thus finishing a shoe.

3 Claims, 15 Drawing Sheets

METHOD OF GLUING A SINGLE SURFACE OF A SHOE

FIELD OF THE INVENTION

The present invention relates to a method of gluing a single surface of a shoe in which a treatment agent is made of a reinforcing agent and adhesive glue and is coated on a lower adhering surface of a vamp to simplify a treatment agent coating step.

BACKGROUND OF THE INVENTION

Referring to FIG. 1, a conventional method 1 of gluing a shoe midsole, a shoe outsole, and a vamp contains a washing and polishing step 10, a surface modifying step 11, a gluing step 12, and an adhering step 13. The washing and polishing step 10 is to wash or polish the shoe midsole and the shoe outsole, thus eliminating a release agent which attaches on the shoe midsole and the shoe outsole. The shoe midsole and the shoe outsole are dried, and the surface modifying step 11 is to modify three adhering surfaces of the shoe outsole, the shoe midsole, and the vamp by applying a surface modifier on the three adhering surfaces. The gluing step 12 is to coat glue on the three adhering surfaces of the shoe outsole, the shoe midsole and the vamp, and then the shoe outsole, the shoe midsole and the vamp are baked and adhered together in the adhering step 13, thus finishing a shoe.

However, before adhering the shoe midsole and the shoe outsole together, the glue is manually coated on two adhering surfaces of the shoe outsole and the shoe midsole, thereby causing gluing complexity and poor production efficiency.

The present invention has arisen to mitigate and/or obviate the afore-described disadvantages.

SUMMARY OF THE INVENTION

The primary objective of the present invention is to provide a method of gluing a single surface of a shoe in which a treatment agent is made of a reinforcing agent and adhesive glue and is coated on a lower adhering surface of a vamp to simplify a treatment agent coating step.

Further objective of the present invention is to provide a method of gluing a single surface of a shoe in which an agent spraying on a shoe midsole is to spray an adhesion promoter on a lower adhering surface of the shoe midsole by ways of a spray gun, thereby reducing agent spraying labor.

Another primary objective of the present invention is to provide a method of gluing a single surface of a shoe in which a shoe outsole and the shoe midsole are automatically sprayed or glued to adhere together, thus enhancing production efficiency.

To obtain above-mentioned objectives, a method of gluing a single surface of a shoe provided by the present invention contains: a first-stage processing and a second-stage processing.

The first-stage processing includes a sole bonding.

The sole bonding has:

a first washing and polishing step including a washing for washing a shoe outsole and a shoe midsole, a first-time baking for baking the shoe outsole and the shoe midsole after the washing or a polishing for polishing an adhesion area of the shoe outsole and the shoe midsole after or before the first-time baking;

a first surface modifying step including a surface modifier coating for coating a surface modifier on an upper adhering surface of the shoe outsole and on a lower adhering surface of the shoe midsole to modify the shoe outsole and the shoe midsole, the first surface modifying step also including a second-time baking for baking the sole outsole and the shoe midsole after the surface modifier coating;

a glue spraying step including: a glue coating on the shoe outsole, an agent spraying on the shoe midsole for spraying an adhesion promoter on the shoe midsole, and a third-time baking;

a sole adhering step including adhering the shoe outsole and the shoe midsole together;

The second-stage processing includes:

a second washing and polishing step containing washing, baking and polishing an upper surface of the shoe sole;

a second surface modifying step containing coating the surface modifier on the upper surface of the shoe sole and baking the shoe sole;

an adhesive agent coating step containing coating adhesive glue on the upper surface of the shoe sole and baking the shoe sole again.

A vamp and sole processing includes:

a vamp treating step containing a vamp polishing or a vamp modifying, wherein when the vamp is made of leather material, a lower adhering surface of the vamp is polished, and when the vamp is made of PU leather or mesh material, the surface modifier is coated on the lower adhering surface of the vamp to enhance adhesion effect;

a treatment agent coating step containing coating a treatment agent on the vamp and a fourth-time baking for baking the vamp;

an adhesion forming step containing a vamp adhering, wherein the vamp is adhered with the shoe sole.

The shoe midsole on which the adhesion promoter is sprayed and the shoe outsole on which the adhesive glue is coated are adhered together to finish the shoe sole; and the adhesive glue is coated on the upper surface of the shoe sole to adhere with the lower adhering surface of the vamp on which the treatment agent is coated, thus finishing a shoe.

DETAILED DESCRIPTION OF THE PREFERRED EMBODIMENTS

Figure 1:
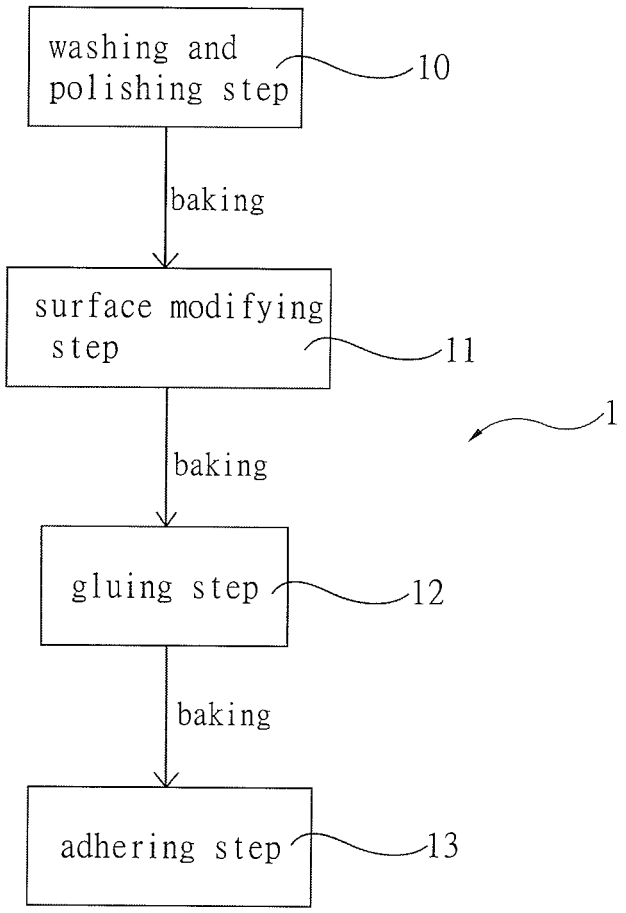
FIG. 1 PRIOR ART
FIG. 1 is a flow chart of a conventional method of gluing a shoe midsole, a shoe outsole, and a vamp.
Figure 2:
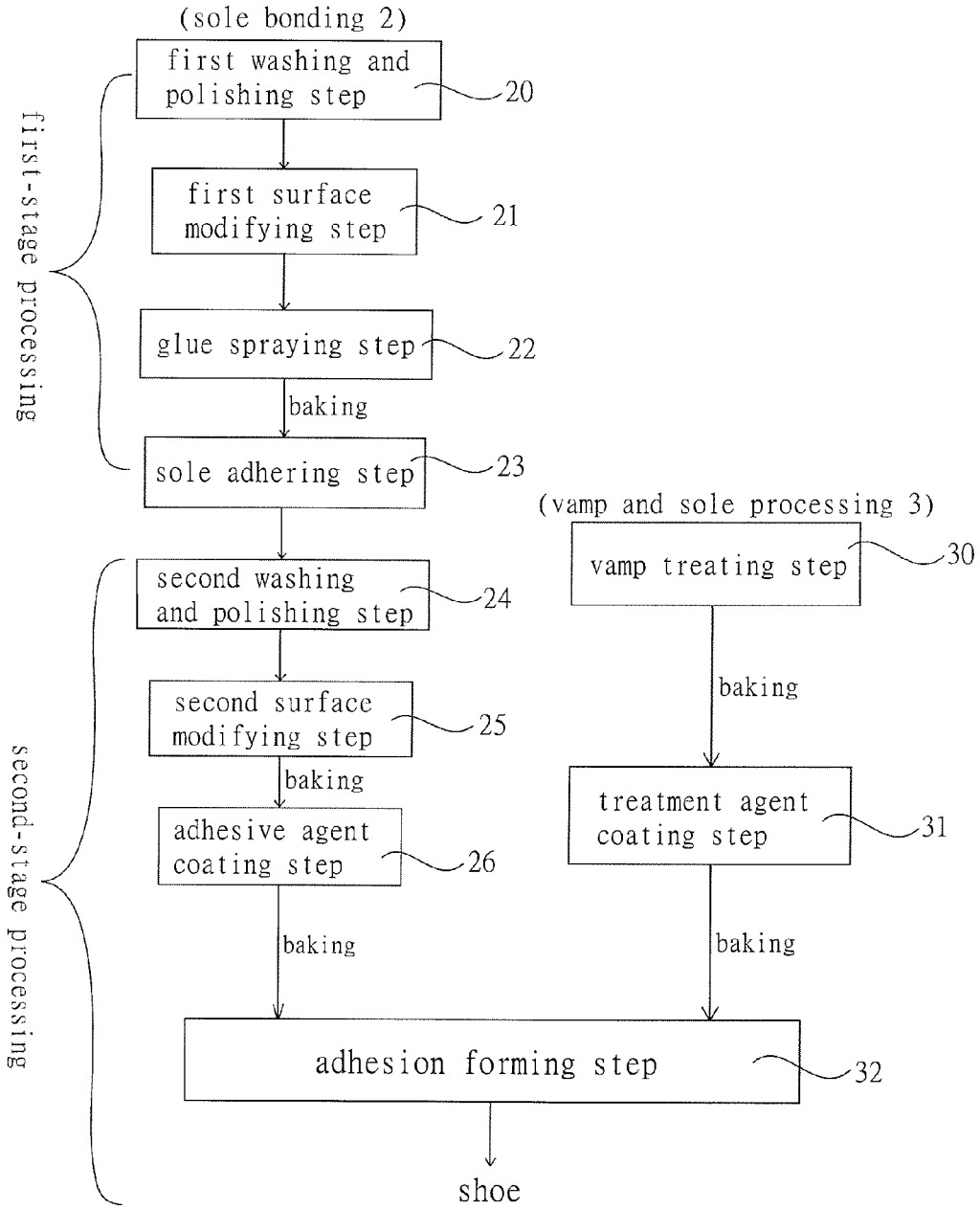
FIG. 2 is a flow chart of a method of gluing a single surface of a shoe according to a preferred embodiment of the present invention.

FIG. 2 is a flow chart of a method of gluing a single surface of a shoe according to a preferred embodiment of the present invention. The method of gluing the single surface of the shoe comprises: a first-stage processing and a second-stage processing.

The first-stage processing includes a sole bonding 2, wherein a shoe outsole and a shoe midsole are sprayed or glued to adhere together, thus forming a shoe sole. The sole bonding 2 has a first washing and polishing step 20, a first surface modifying step 21, a glue spraying step 22, and a sole adhering step 23.

The second-stage processing includes a second washing and polishing step 24, a second surface modifying step 25, and an adhesive agent coating step 26. A vamp and sole processing 3 includes a vamp treating step 30, a treatment agent coating step 31, and an adhesion forming step 32, wherein a vamp is adhered with the shoe sole to finish a shoe.

Figure 3:
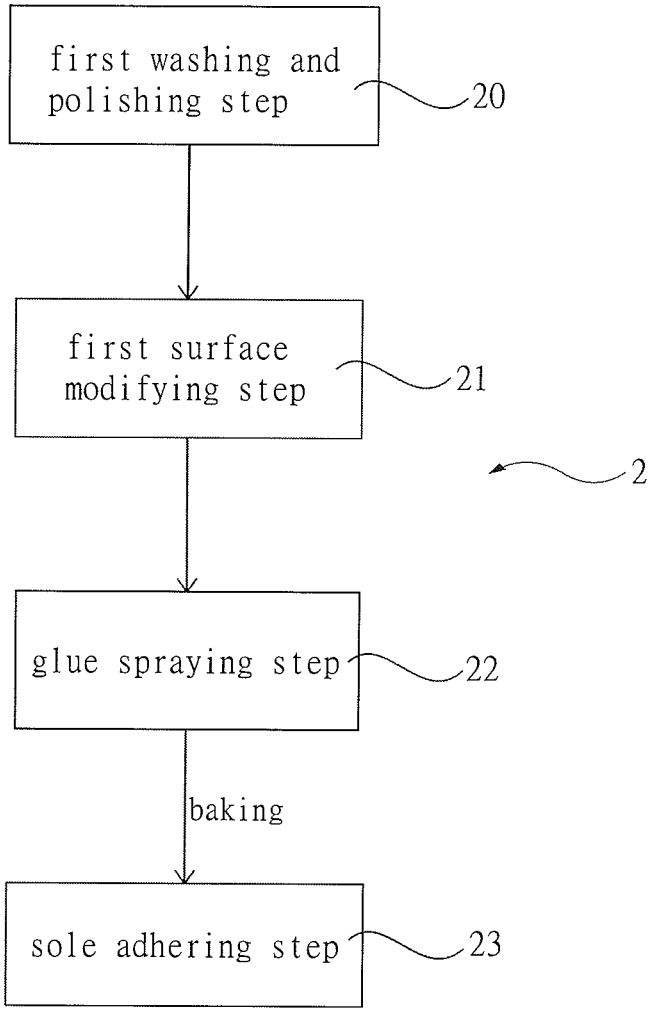
FIG. 3 is a flow chart showing a first-stage processing of the method of gluing the single surface of the shoe according to the preferred embodiment of the present invention.

FIG. 3 is a flow chart showing the first-stage processing of the method of gluing the single surface of the shoe according to the preferred embodiment of the present invention. The first-stage processing contains:

the first washing and polishing step 20 including a washing, a first-time baking or a polishing;

the first surface modifying step 21 including a surface modifier coating and a second-time baking;

the glue spraying step 22 including a glue coating on the shoe outsole, an agent spraying on the shoe midsole, and a third-time baking;

the sole adhering step 23 including adhering the shoe outsole and the shoe midsole together.

Figure 4:
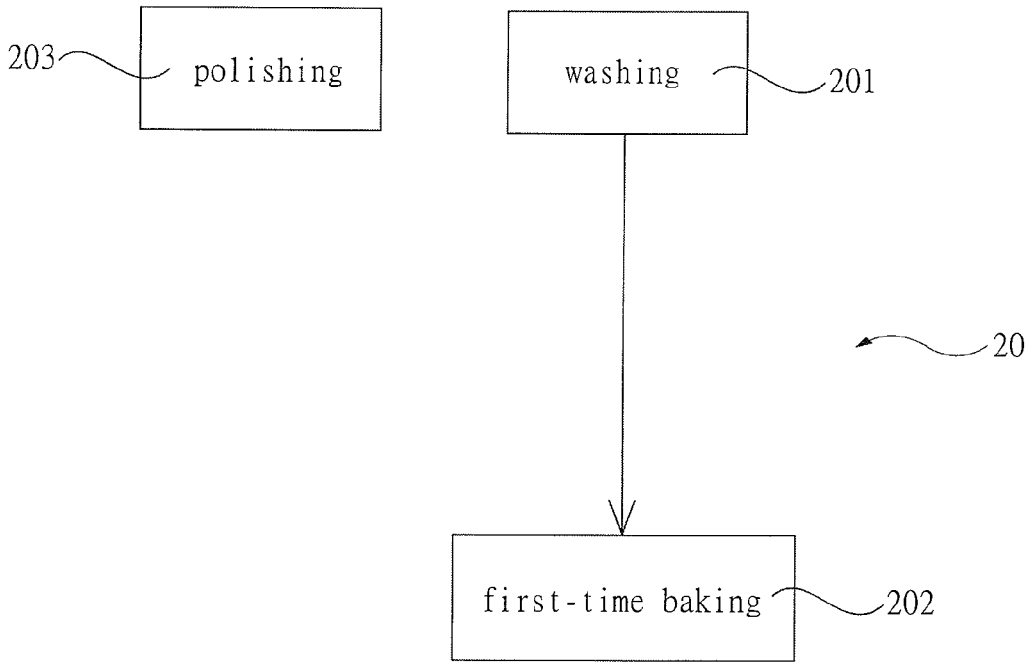
FIG. 4 is a flow chart showing a first washing and polishing step of the method of gluing the single surface of the shoe according to the preferred embodiment of the present invention.

FIG. 4 is a flow chart showing the first washing and polishing step of the method of gluing the single surface of the shoe according to the preferred embodiment of the present invention. The first washing and polishing step 20 includes the washing 201, the first-time baking 202 or the polishing 203.

The washing 201 is to wash the shoe outsole and the shoe midsole.

The first-time baking 202 is to bake the shoe outsole and the shoe midsole after the washing 201.

The polishing 203 is to polish an adhesion area of the shoe outsole and the shoe midsole after or before the first-time baking 202.

Figure 5:
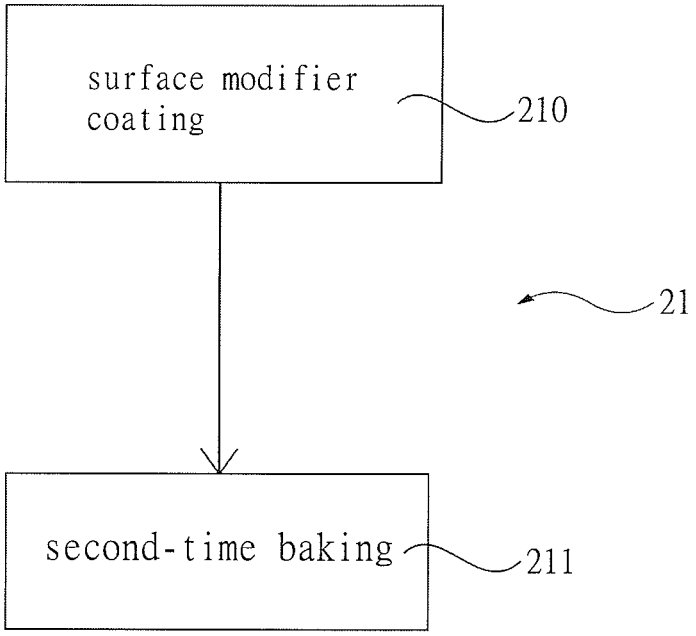
FIG. 5 is a flow chart showing a first surface modifying step of the method of gluing the single surface of the shoe according to the preferred embodiment of the present invention.

FIG. 5 is a flow chart showing the first surface modifying step of the method of gluing the single surface of the shoe according to the preferred embodiment of the present invention. The first surface modifying step 21 contains the surface modifier coating 210 and the second-time baking 211.

The surface modifier coating 210 is to coat a surface modifier on an upper adhering surface of the shoe outsole and on a lower adhering surface of the shoe midsole.

The second-time baking 211 is to bake the sole outsole and the shoe midsole after the surface modifier coating 210.

Figure 6:
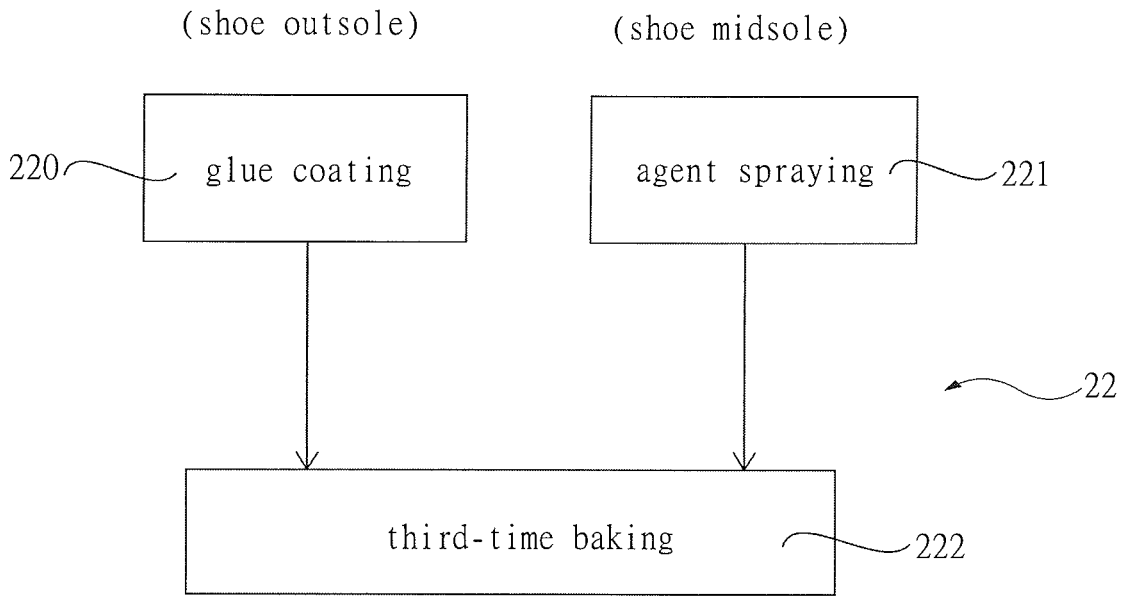
FIG. 6 is a flow chart showing a glue spraying step of the method of gluing the single surface of the shoe according to the preferred embodiment of the present invention.

FIG. 6 is a flow chart showing the glue spraying step of the method of gluing the single surface of the shoe according to the preferred embodiment of the present invention. The glue spraying step 22 includes the glue coating 220 on the shoe outsole, the agent spraying 221 on the shoe midsole, and the third-time baking 222.

The glue coating 220 on the shoe outsole is to coat adhesive glue on the upper adhering surface of the shoe outsole.

The agent spraying 221 on the shoe midsole is to spray an adhesion promoter on the lower adhering surface of the shoe midsole by ways of a spray gun.

The third-time baking 222 is to bake the shoe outsole and the shoe midsole after the agent spraying 221.

Figure 7:
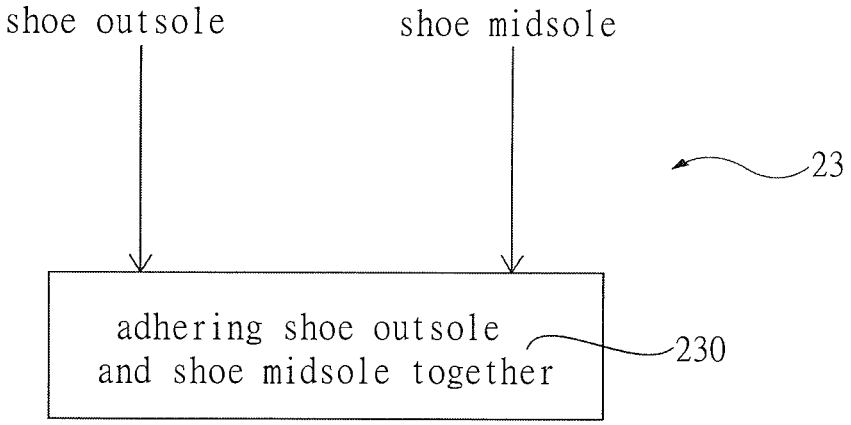
FIG. 7 is a flow chart showing a sole adhering step of the method of gluing the single surface of the shoe according to the preferred embodiment of the present invention.

FIG. 7 is a flow chart showing the sole adhering step of the method of gluing the single surface of the shoe according to the preferred embodiment of the present invention. The sole adhering step 23 includes adhering the shoe outsole and the shoe midsole together 230 to finish the shoe sole.

Figure 8:
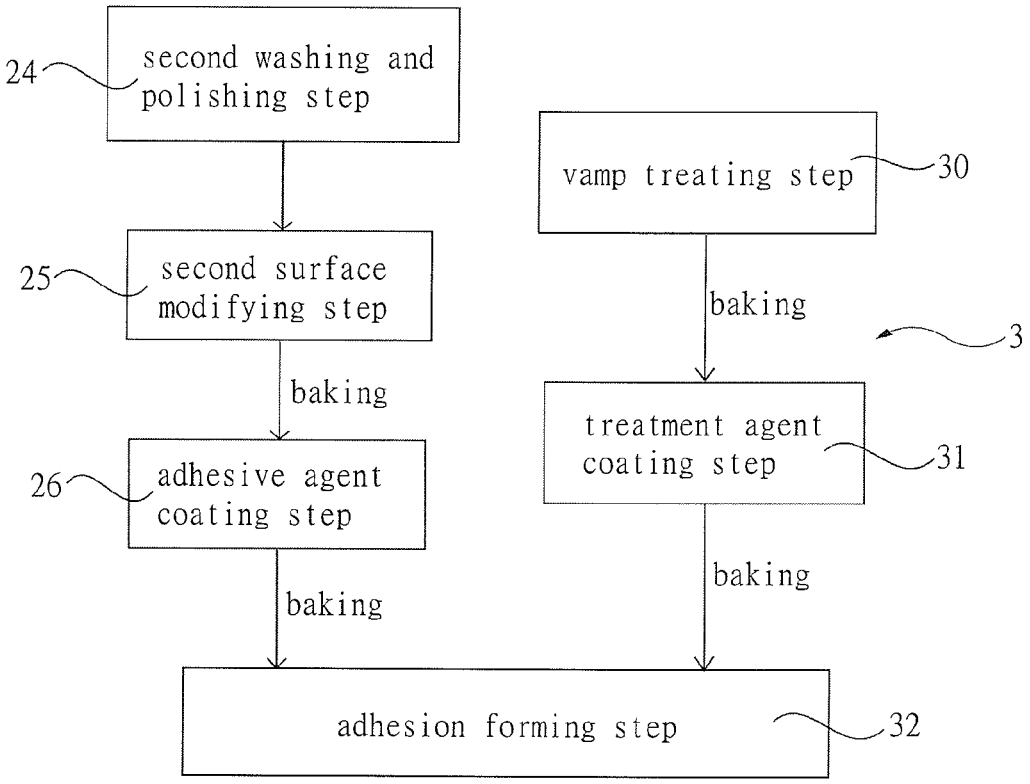
FIG. 8 is a flow chart showing a vamp and sole processing of the method of gluing the single surface of the shoe according to the preferred embodiment of the present invention.

FIG. 8 is a flow chart showing the vamp and sole processing of the method of gluing the single surface of the shoe according to the preferred embodiment of the present invention. The vamp and sole processing includes a shoe sole processing and a vamp processing.

The shoe sole processing contains:

the second washing and polishing step 24 including washing, baking and polishing an upper surface of the shoe sole;

the second surface modifying step 25 including coating the surface modifier on the upper surface of the shoe sole and baking the shoe sole;

the adhesive agent coating step 26 including coating the adhesive glue on the upper surface of the shoe sole and baking the shoe sole again.

The vamp processing contains:

the vamp treating step 30 including polishing or modifying the vamp;

the treatment agent coating step 31 including coating a treatment agent on the vamp and a fourth-time baking;

the adhesion forming step 32 including adhering the vamp and the shoe sole together.

Figure 9:
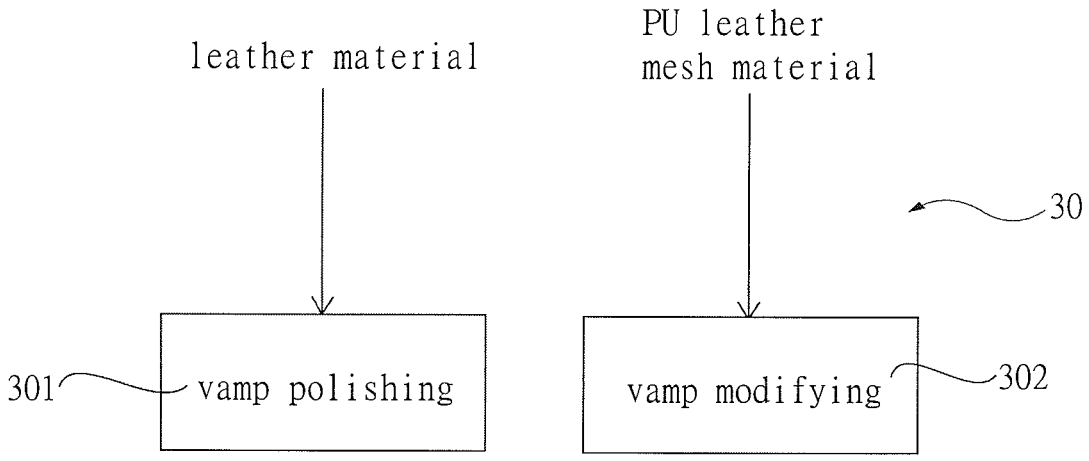
FIG. 9 is a flow chart showing a vamp treating step of the method of gluing the single surface of the shoe according to the preferred embodiment of the present invention.

FIG. 9 is a flow chart showing the vamp treating step of the method of gluing the single surface of the shoe according to the preferred embodiment of the present invention. The vamp treating step contains:

a vamp polishing 301, wherein when the vamp is made of leather material, a lower adhering surface of the vamp is polished;

a vamp modifying 302, wherein when the vamp is made of PU leather or mesh material, the surface modifier is coated on the lower adhering surface of the vamp to enhance adhesion effect.

Figure 10:
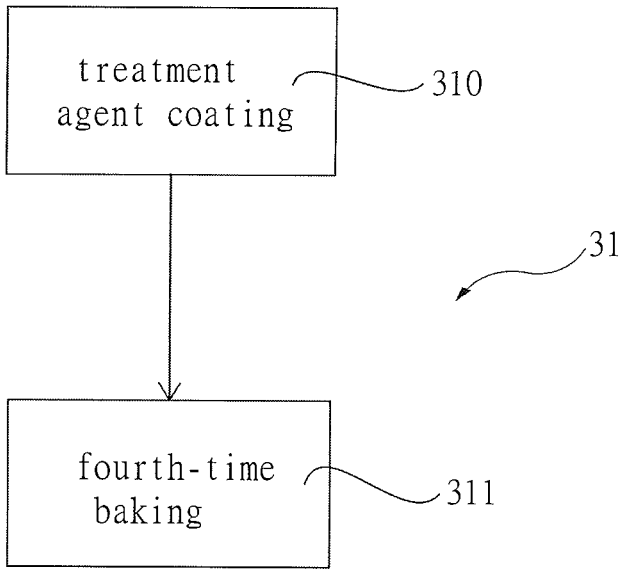
FIG. 10 is a flow chart showing a treatment agent coating step of the method of gluing the single surface of the shoe according to the preferred embodiment of the present invention.

FIG. 10 is a flow chart showing the treatment agent coating step of the method of gluing the single surface of the shoe according to the preferred embodiment of the present invention. The treatment agent coating step contains:

a treatment agent coating 310 on the vamp, wherein the treatment agent is coated on the lower adhering surface of the vamp;

a fourth-time baking 311, wherein the vamp is baked after the treatment agent coating 310 on the vamp.

Figure 11:
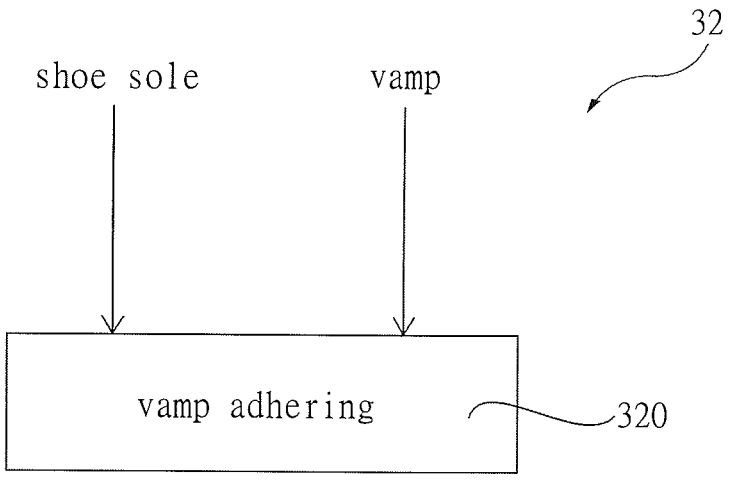
FIG. 11 is a flow chart showing an adhesion forming step of the method of gluing the single surface of the shoe according to the preferred embodiment of the present invention.

FIG. 11 is a flow chart showing the adhesion forming step of the method of gluing the single surface of the shoe according to the preferred embodiment of the present invention. The adhesion forming step contains a vamp adhering 320, wherein the vamp is adhered with the shoe sole, thus finishing the shoe.

Figure 12:
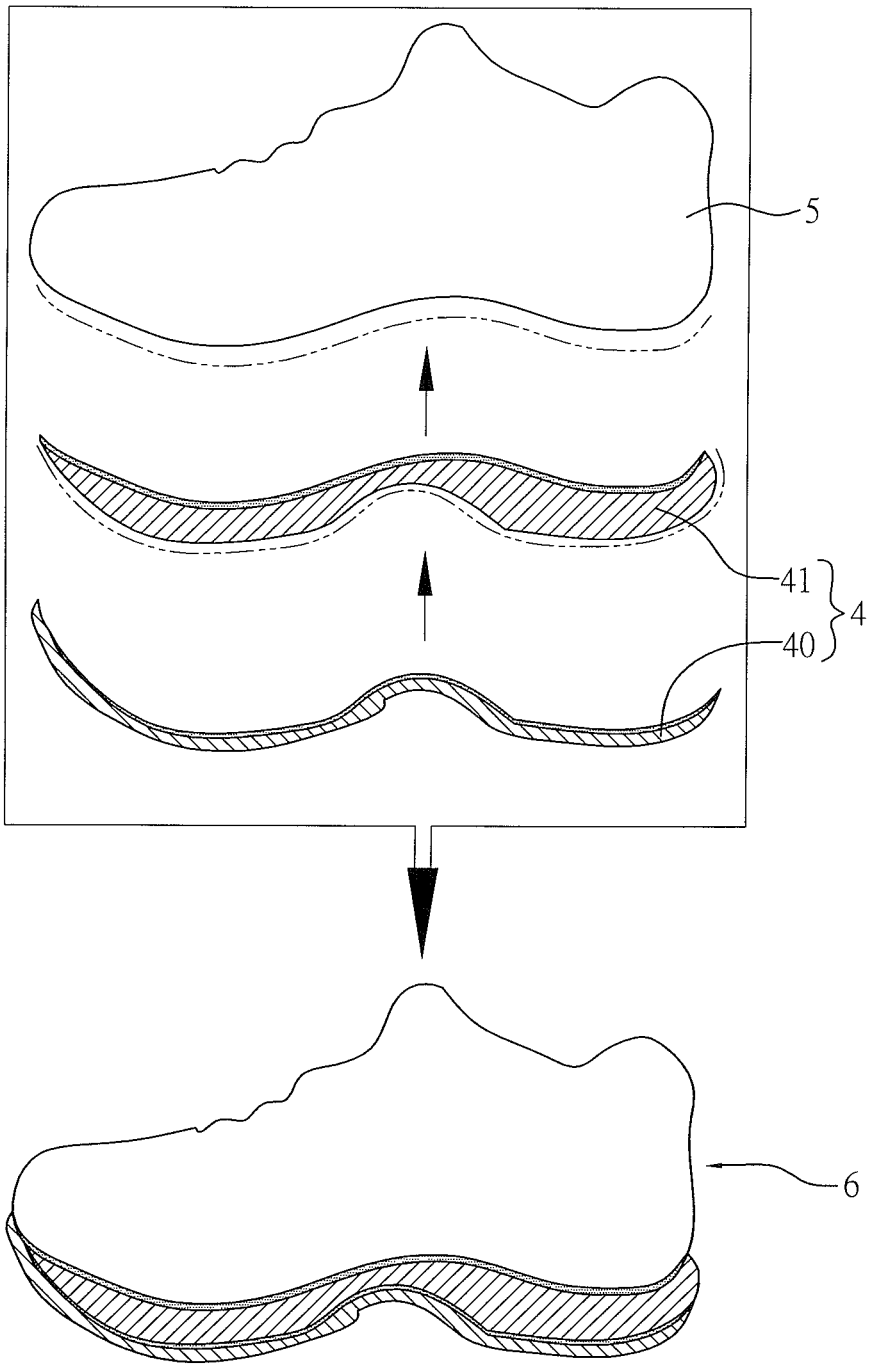
FIG. 12 is a cross sectional view showing a shoe being finished by using the method of gluing the single surface of the shoe according to the preferred embodiment of the present invention.

FIG. 12 is a cross sectional view showing the shoe being finished by using the method of gluing the single surface of the shoe according to the preferred embodiment of the present invention. The shoe 6 is comprised of the shoe sole 4 and the vamp 5, and the shoe sole 4 includes the shoe outsole 40 and the shoe midsole 41.

Figure 13:
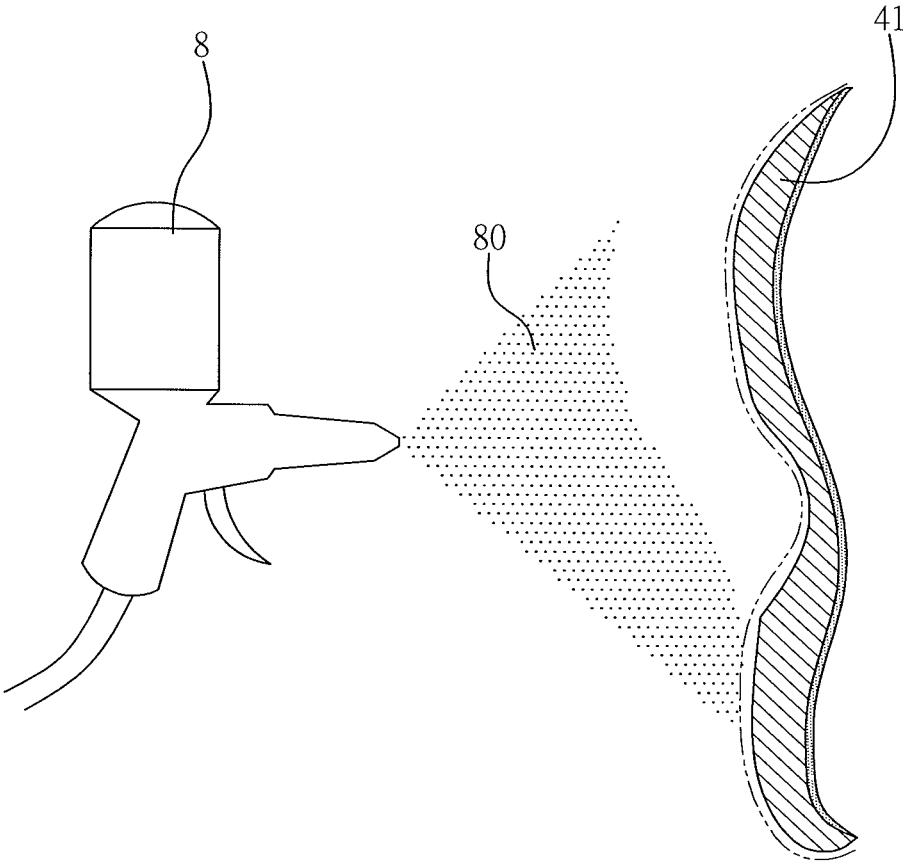
FIG. 13 is a cross sectional view showing an agent being sprayed on a shoe midsole according to the preferred embodiment of the present invention.

FIG. 13 is a cross sectional view showing the agent being sprayed on the shoe midsole according to the preferred embodiment of the present invention. After the shoe midsole 41 is washed and modified, the surface modifier is coated on the lower adhering surface of the shoe midsole, and the shoe midsole 41 is dried, thereafter the adhesion promoter 80 is sprayed on the lower adhering surface of the shoe midsole 41 by ways of the spray gun 8.

Figure 14:
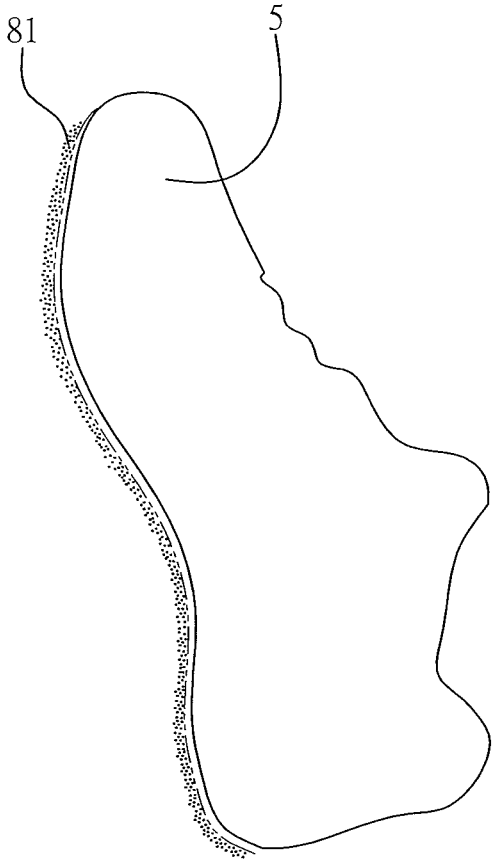
FIG. 14 is a side plane view showing a treatment agent being coated on a vamp according to the preferred embodiment of the present invention.

FIG. 14 is a side plane view showing the treatment agent being coated on the vamp according to the preferred embodiment of the present invention. After the lower adhering surface of the vamp 5 is polished, the treatment agent 81 is coated on the lower adhering surface of the vamp 5, wherein the treatment agent is made of a reinforcing agent and the adhesive glue.

Figure 15:
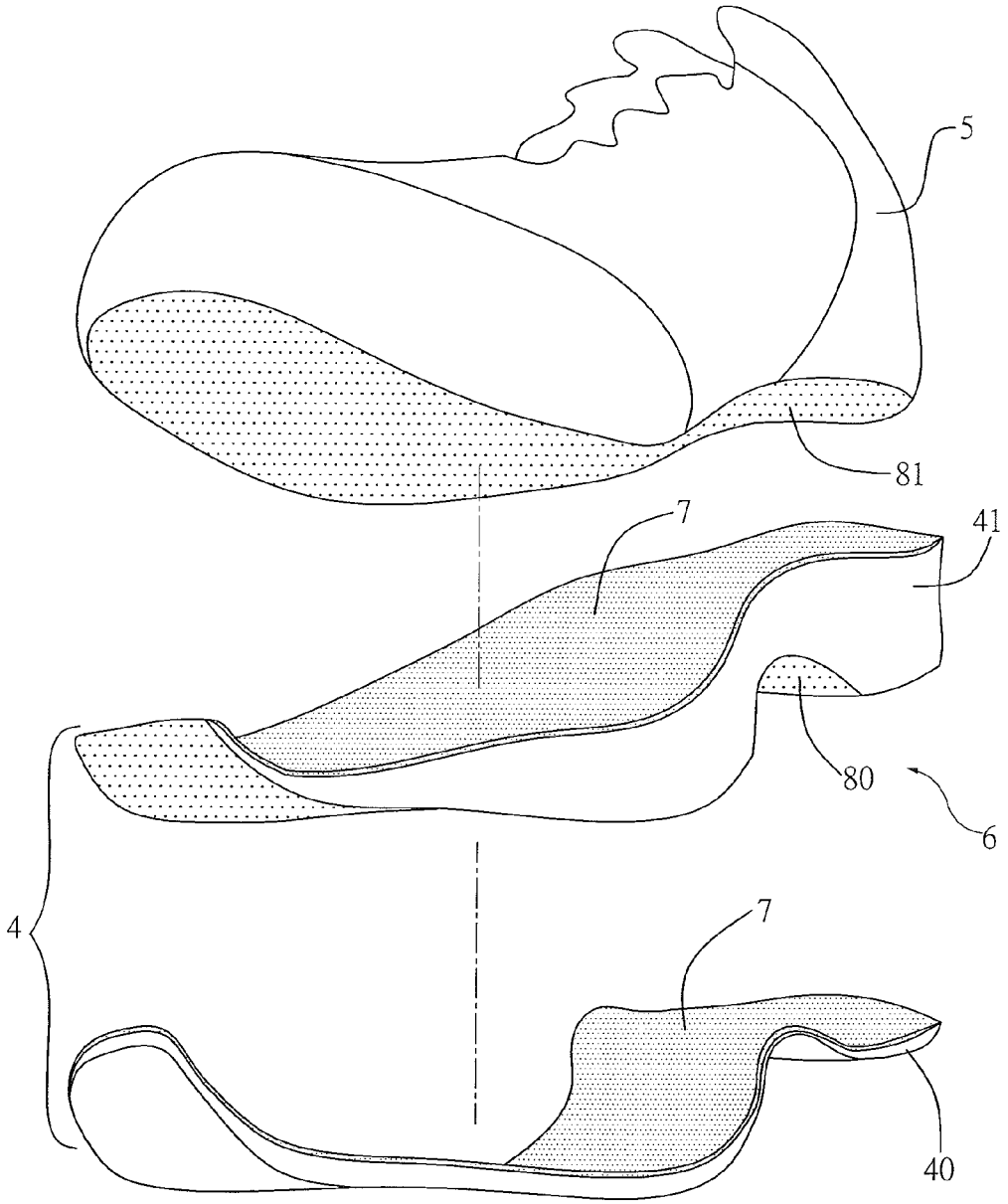
FIG. 15 is a perspective view showing the exploded components of a shoe sole and the vamp according to the preferred embodiment of the present invention.

FIG. 15 is a perspective view showing the exploded components of the shoe sole and the vamp according to the preferred embodiment of the present invention. The shoe midsole 41 (on which the adhesion promoter 80 is sprayed) and the shoe outsole 40 (on which the adhesive glue 7 is coated) are adhered together, thus finishing the shoe sole 4. Thereafter, the adhesive glue 7 is coated on the upper surface of the shoe sole 4 (i.e., an upper surface the shoe midsole 41) to adhere with the lower adhering surface of the vamp 5 on which the treatment agent 81 is coated, thus finishing the shoe 6.

Furthermore, the treatment agent 81 is coated on the lower adhering surface of the vamp 5 after modifying or roughening the vamp 5, and then the adhesive glue 7 is coated on the lower adhering surface of the vamp 5, the adhesion promoter 80 is sprayed on the upper surface of the shoe sole 4, thereafter the shoe sole 4 and the vamp 5 are baked and adhered together, thus finishing the shoe 6.

Accordingly, the method of gluing the single surface of the shoe has advantages as follows:

1. The treatment agent is made of the reinforcing agent and the adhesive glue and is coated on the lower adhering surface of the vamp to simplify the treatment agent coating step.

2. The agent spraying 221 on the shoe midsole is to spray the adhesion promoter on the lower adhering surface of the shoe midsole by ways of the spray gun, thereby reducing labor cost.

3. In the sole bonding, the shoe outsole and the shoe midsole are automatically sprayed or glued to adhere together, thus enhancing production efficiency.

While we have shown and described various embodiments in accordance with the present invention, it is clear to those skilled in the art that further embodiments may be made without departing from the scope of the present invention.

What is claimed is:

1. A method of gluing a single surface of a shoe comprising: a first-stage processing and a second-stage processing;

the first-stage processing including a sole bonding;

the sole bonding having:

a first washing and polishing step including a washing for washing a shoe outsole and a shoe midsole, a first-time baking for baking the shoe outsole and the shoe midsole after the washing or a polishing for polishing an adhesion area of the shoe outsole and the shoe midsole after or before the first-time baking;

a first surface modifying step including a surface modifier coating for coating a surface modifier on an upper adhering surface of the shoe outsole and on a lower adhering surface of the shoe midsole to modify the shoe outsole and the shoe midsole, the first surface modifying step also including a second-time baking for baking the sole outsole and the shoe midsole after the surface modifier coating;

a glue spraying step including: a glue coating on the shoe outsole, an agent spraying on the shoe midsole for spraying an adhesion promoter on the shoe midsole, and a third-time baking;

a sole adhering step including adhering the shoe outsole and the shoe midsole together;

the second-stage processing including:

a second washing and polishing step containing washing, baking and polishing an upper surface of the shoe sole;

a second surface modifying step containing coating the surface modifier on the upper surface of the shoe sole and baking the shoe sole;

an adhesive agent coating step containing coating adhesive glue on the upper surface of the shoe sole and baking the shoe sole again;

a vamp and sole processing including:

a vamp treating step containing a vamp polishing or a vamp modifying, wherein when the vamp is made of leather material, a lower adhering surface of the vamp is polished, and when the vamp is made of PU leather or mesh material, the surface modifier is coated on the lower adhering surface of the vamp to enhance adhesion effect;

a treatment agent coating step containing coating a treatment agent on the vamp and a fourth-time baking for baking the vamp;

an adhesion forming step containing a vamp adhering, wherein the vamp is adhered with the shoe sole;

characterized in that:

the shoe midsole on which the adhesion promoter is sprayed and the shoe outsole on which the adhesive glue is coated are adhered together to finish the shoe sole; and the adhesive glue is coated on the upper surface of the shoe sole to adhere with the lower adhering surface of the vamp on which the treatment agent is coated, thus finishing a shoe.

2. The method of gluing the single surface of the shoe as claimed in claim 1, wherein the adhesion promoter is sprayed on the upper adhering surface of the shoe outsole, and the adhesive glue is coated on the lower adhering surface of the vamp.

3. The method of gluing the single surface of the shoe as claimed in claim 1, wherein the treatment agent is made of a reinforcing agent and the adhesive glue.

* * * * *